US009142901B2

(12) United States Patent
Ando et al.

(10) Patent No.: US 9,142,901 B2
(45) Date of Patent: Sep. 22, 2015

(54) FEMALE TERMINAL

(75) Inventors: Shuhei Ando, Shizuoka (JP); Terumichi Matsumoto, Shizuoka (JP); Hajime Kato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/125,435

(22) PCT Filed: Jun. 8, 2012

(86) PCT No.: PCT/JP2012/003770

§ 371 (c)(1),
(2), (4) Date: Dec. 11, 2013

(87) PCT Pub. No.: WO2012/176395

PCT Pub. Date: Dec. 27, 2012

(65) Prior Publication Data

US 2014/0127954 A1 May 8, 2014

(30) Foreign Application Priority Data

Jun. 21, 2011 (JP) ..... 2011-137170

(51) Int. Cl.
*H01R 13/11* (2006.01)
*H01R 13/187* (2006.01)
*H01R 43/16* (2006.01)

(52) U.S. Cl.
CPC ..... *H01R 13/11* (2013.01); *H01R 13/113* (2013.01); *H01R 13/187* (2013.01); *H01R 43/16* (2013.01)

(58) Field of Classification Search
CPC .... H01R 13/87; H01R 13/187; H01R 23/727; H01R 13/15; H01R 13/113
USPC ..... 439/843, 844, 845, 847, 852, 862, 867
See application file for complete search history.

(56) References Cited

U.S. PATENT DOCUMENTS 5,722,925 A 3/1998 Kameyama et al.
5,873,754 A * 2/1999 Hotea ..... 439/843

(Continued)

FOREIGN PATENT DOCUMENTS

CN 1164300 A 11/1997
CN 1719671 A 1/2006

(Continued)

OTHER PUBLICATIONS

Communication dated Jan. 6, 2015, issued by the Japanese Patent Office in counterpart Japanese application No. 2011-137170.

(Continued)

*Primary Examiner* — Abdullah Riyami
*Assistant Examiner* — Thang Nguyen
(74) *Attorney, Agent, or Firm* — Sughrue Mion, PLLC

(57) ABSTRACT

An elastic contact member (21) formed as a member separate from an electrical connector (11) for a male terminal to be inserted, installed in the electrical connector (11), and gets into contact with the male terminal inserted in the electrical connector (11). The elastic contact member (21) includes: first elastic contact pieces (22) formed with a space (S) in between in a widthwise direction (Y), cantilevered at one end side, in the insertion direction (X), of a surface of the elastic contact member (21) extending in the insertion direction (X), and configured to get into contact with the male terminal inserted into the electrical connector (11); and a second elastic contact piece (23) disposed in the space (S) and configured to get into contact with the male terminal inserted into the electrical connector (11).

9 Claims, 7 Drawing Sheets

(56) References Cited

U.S. PATENT DOCUMENTS

| | | | | |
|---|---|---|---|---|
| 6,062,919 | A | 5/2000 | Trafton | |
| 6,264,509 | B1 * | 7/2001 | Kwang et al. | 439/852 |
| 6,293,833 | B1 * | 9/2001 | Kamath | 439/851 |
| 7,150,660 | B2 * | 12/2006 | Allgood et al. | 439/845 |
| 2011/0045712 | A1 | 2/2011 | Mukuno | |

FOREIGN PATENT DOCUMENTS

| | | | |
|---|---|---|---|
| JP | 10-503319 | A | 3/1998 |
| JP | 2002-100430 | | 4/2002 |
| JP | 2005-166300 | A | 6/2005 |
| JP | 2011-44256 | | 3/2011 |
| JP | 2011-086540 | A | 4/2011 |

OTHER PUBLICATIONS

Communication dated Jun. 3,2015 from the State Intellectual Property Office of People's Republic of China in counterpart Application No. 201280030935.3.

English-language translation of International Search Report from the Japanese Patent Office in PCT/JP2012/003770 mailed Sep. 24, 2012.

* cited by examiner

FEMALE TERMINAL

TECHNICAL FIELD

The present invention relates to a female terminal: including an electrical connector into which a male terminal is to be inserted; and configured to be electrically connected to the male terminal inserted in the electrical connector.

BACKGROUND ART

Patent Literature 1 and Patent Literature 2 describe female terminals to be electrically connected to their respective male terminals.

Such female terminals each mainly include an electrical connector into which the male terminal is to be inserted; elastic contact members built in the electrical connector, and being capable of getting into contact with the male terminal; and an electrical wire crimp part to be crimped onto an electrical wire electrically connected to the male terminal inserted in the electrical connector.

Once the male terminal is inserted into the electrical connector in which the elastic contact members are arranged, the elastically-deformed elastic contact pieces of the elastic contact members get into pressure contact with the male terminal due to resilience. Thereby, the female terminal is electrically connected to the male terminal. In addition, multiple elastic contact pieces are provided to each elastic contact member for the purpose of increasing the area of the contact between the elastic contact member and the male terminal.

CITATION LIST

Patent Literature

[PTL 1] Japanese Unexamined Patent Application Publication No. 2002-100430

[PTL 2] Japanese Unexamined Patent Application Publication No. 2011-44256

SUMMARY OF INVENTION

As a process of forming multiple elastic contact pieces in each elastic contact member, a process is sometimes used in which: slits with an appropriate shape are formed in the base material of the elastic contact member by punching; and the elastic contact pieces are formed between the slits.

When such punching is carried out, it is desirable that the width of each slit have a dimension greater than the thickness of the base material of the elastic contact member to extend the life of the die. In exchange for making the width of the slit greater, the number of elastic contact pieces formable in the base material of the elastic contact member decreases naturally.

As described above, it is desirable to form more elastic contact pieces in the elastic contact member in order to increase the area of the contact between the elastic contact member and the male terminal, whereas it is important to design the elastic contact member to include fewer elastic contact pieces in order to extend the life of the die used for the process.

An object of the present invention is to provide a female terminal which enables more elastic contact pieces than ever to be formed in each elastic contact member without sacrificing the life of the die used for the process.

An aspect of the present invention is a female terminal including: an electrical connector for a male terminal to be inserted; and an elastic contact member formed as a member separate from the electrical connector, installed in the electrical connector, and configured to get into contact with the male terminal inserted in the electrical connector. The elastic contact member includes first elastic contact pieces formed with a space in between in a widthwise direction orthogonal to an insertion direction of the male terminal to be inserted into the electrical connector, cantilevered at one end side, in the insertion direction, of a surface of the elastic contact member extending in the insertion direction, and configured to get into contact with the male terminal inserted into the electrical connector, and a second elastic contact piece disposed in the space and configured to get into contact with the male terminal inserted into the electrical connector.

The above-described aspect makes it possible to increase the number of elastic contact pieces formable in the elastic contact member even if the space between the first elastic contact pieces and the space between the second elastic contact pieces are expanded, because the second elastic contact piece or pieces are disposed in the space between the first elastic contact pieces. For this reason, owing to the process easiness in processing the elastic contact member formed as a separate member, more elastic contact pieces than ever can be formed in the elastic contact member without sacrificing the life of the die used to punch portions from the elastic contact member to form the space between the first elastic contact pieces and the space between the second elastic contact pieces.

The electrical connector may include an excessive displacement preventing protrusion in at least one of surfaces of the electrical connector extending in the insertion direction, the excessive displacement preventing protrusion being configured to prevent excessive displacement of at least one of the first and second elastic contact pieces. The excessive displacement preventing protrusion may be disposed with a predetermined clearance in a displacement direction of, and from the at least one of the first and second elastic contact pieces of the elastic contact member installed in the electrical connector. The excessive displacement preventing protrusion may restrict displacement of the at least one of the first and second elastic contact pieces due to a contact with the male terminal inserted in the electrical connector to limit the displacement within the predetermined clearance.

In this configuration, the electrical connector formed as a member separate from the elastic contact member includes the excessive displacement preventing protrusion. This makes it possible to prevent excessive displacement of the at least one of the first and second elastic contact pieces.

Because the excessive displacement preventing protrusion is provided to the electrical connector, it is possible to structurally achieve the excessive displacement preventing function for the at least one of the first and second elastic contact pieces easily even though the elastic contact member is constructed as the member separate from the electrical connector.

The first elastic contact pieces and the second elastic contact piece may be formed integrally with the surface of the elastic contact member. The second elastic contact piece may be disposed in the space by being folded back at an other end side of the surface of the elastic contact member in the insertion direction.

In the foregoing configuration, the first elastic contact pieces and the second elastic contact piece are formed in the same surface of the electrical connector. In addition, the first elastic contact pieces and the second elastic contact piece are formed at positions shifted from each other in the direction in which the first elastic contact pieces are arranged with the space in between. With this structure, in a bending process of the first elastic contact pieces and the second elastic contact piece, the second elastic contact piece can be easily disposed between the first elastic contact pieces.

The female terminal may include elastic contact members respectively mounted on two opposite surfaces of the electrical connector, wherein the elastic contact members mounted on the two surfaces of the electrical connector hold the male terminal therebetween.

The foregoing configuration makes it possible to enhance the reliability of the electrical connection between the electrical connector and the male terminal, because the male terminal is held between and by the elastic contact members of the respective two surfaces.

DESCRIPTION OF EMBODIMENTS

Figure 1:
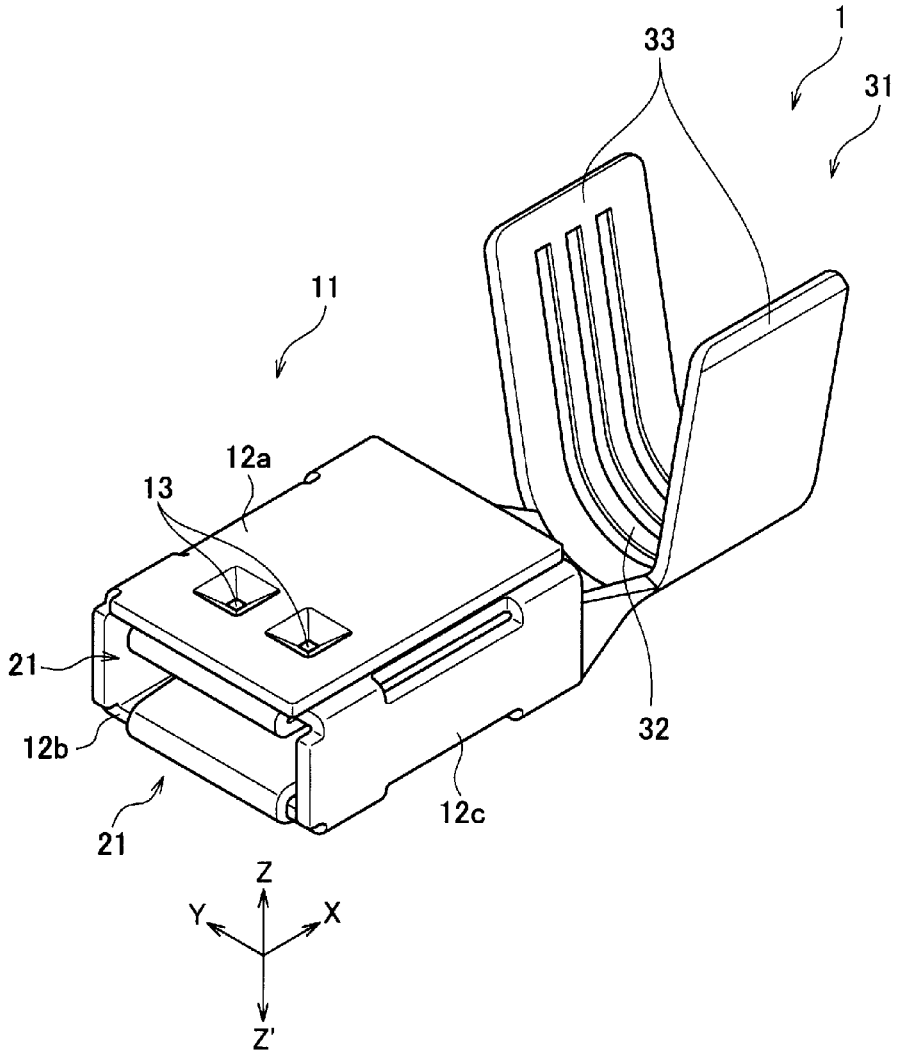
FIG. 1 is a perspective view showing a female terminal according to the first embodiment of the present invention.

Descriptions will be hereinbelow provided for a female terminal 1, 1A of embodiments of the present invention by referring to the drawings. To begin with, detailed descriptions will be provided for a configuration of the female terminal 1 of a first embodiment of the present invention by referring to FIG. 1 and FIG. 2.

Figure 2:
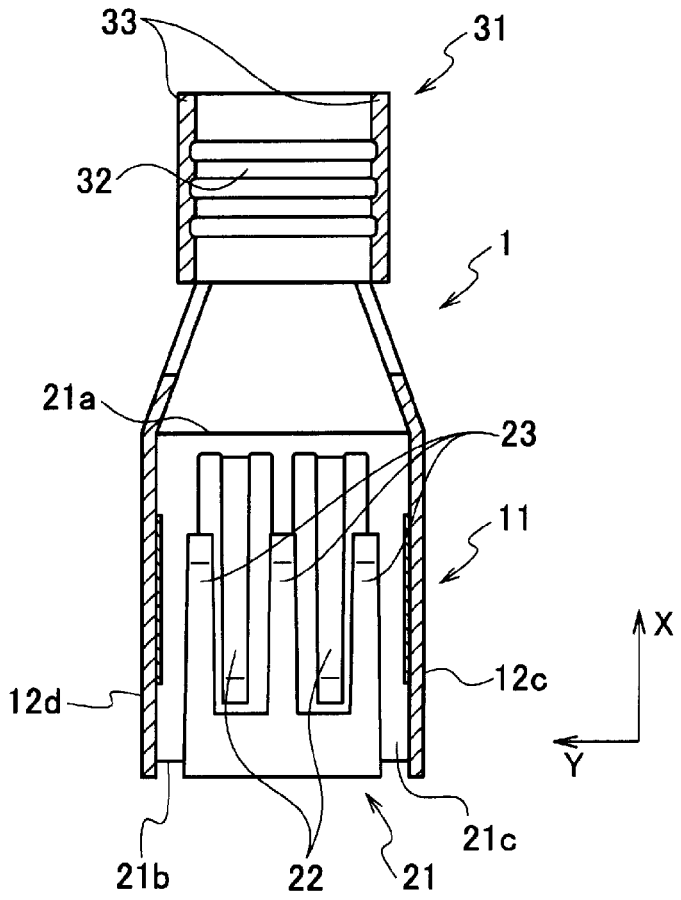
FIG. 2 is plan and cross-sectional views of the female terminal according to the first embodiment of the present invention.

FIG. 1 is a perspective view showing the female terminal 1 of the first embodiment of the present invention. FIG. 2 is a cross-sectional view of the female terminal 1.

The female terminal 1 of the first embodiment of the present invention is electrically connected to a male terminal while holding a high-voltage electrical wire in use for an electrical system of a vehicle and the like.

As shown in FIG. 1 and FIG. 2, the female terminal 1 of the first embodiment of the present invention includes, among other things, an electrical connector 11 into which the male terminal is to be inserted, elastic contact members 21 capable of getting into contact with the male terminal inserted in the electrical connector 11, and an electrical wire crimp part 31 to which an electrical wire (unillustrated) electrically connected to the male terminal inserted in the electrical connector 11 is connected by crimping.

The electrical connector 11 is shaped like a rectangular box, which is surrounded by surfaces (a top surface 12*a*, a bottom surface 12*b* and lateral surfaces 12*c*, 12*d*) extending in an insertion direction of the male terminal (unillustrated) to be inserted into the electrical connector 11 (in an arrow-X direction in FIG. 1 and FIG. 2).

Paired excessive displacement preventing protrusions 13 configured to prevent excessive displacement of the corresponding elastic contact member 21 are provided to each of the top surface 12*a* and the bottom surface 12*b* of the electrical connector 11. Detailed descriptions will be provided for the excessive displacement preventing protrusions 13 later.

The elastic contact member 21, which is elastic and capable of getting into contact with the male terminal (unillustrated) inserted into the inside of the electrical connector 11, is mounted on each of the top surface 12*a* and the bottom surface 12*b* of the electrical connector 11.

Figure 3:
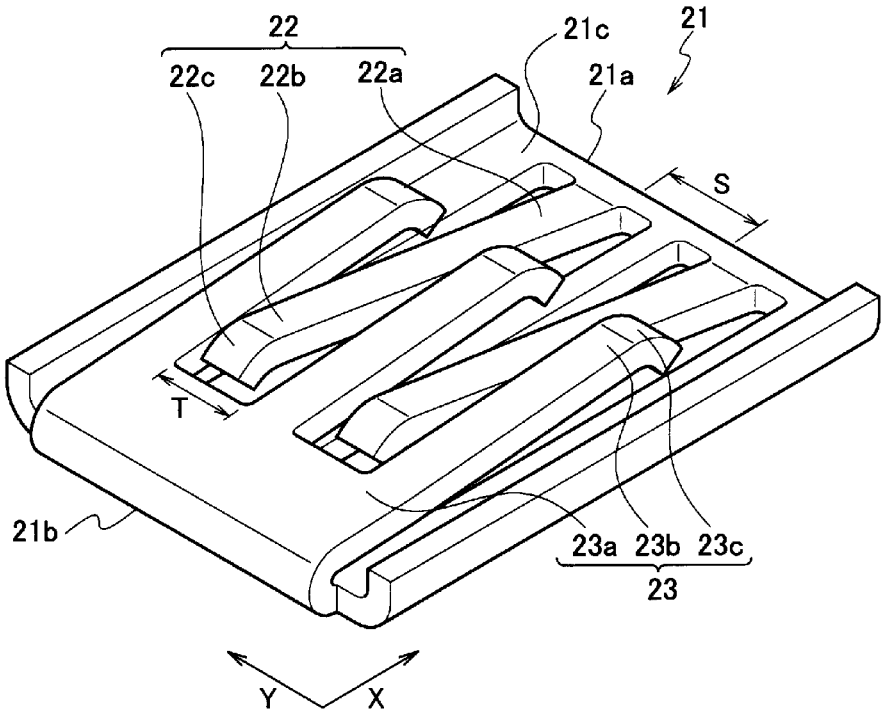
FIG. 3 is a perspective view showing an elastic contact member of the female terminal according to the first embodiment of the present invention.
Figure 4:
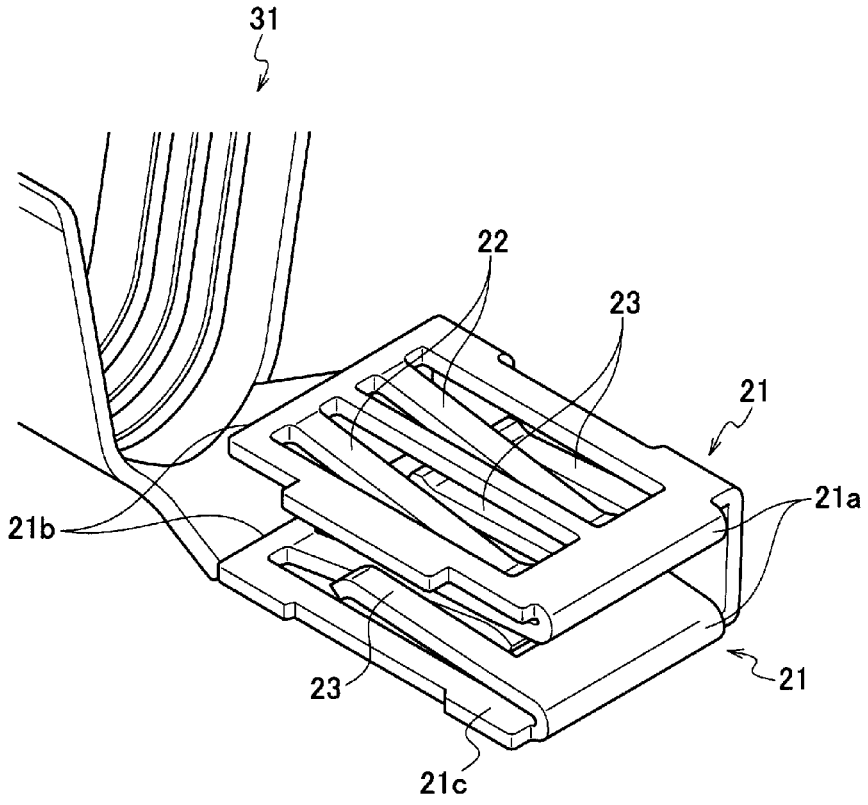
FIG. 4 is a perspective view showing the elastic contact members and an electrical wire crimp part of the female terminal according to the first embodiment of the present invention.

Each elastic contact member 21 is formed as a member separate from the electrical connector 11. As shown in FIGS. 2 to 4, two first elastic contact pieces 22 and three second elastic contact pieces 23 are formed in each of the elastic contact members 21 respectively mounted on the top surface 12*a* and the bottom surface 12*b* of the electrical connector 11. Detailed descriptions will be later provided for the first elastic contact pieces 22 and the second elastic contact pieces 23.

Once the male terminal (unillustrated) is inserted into the electrical connector 11, the elastic contact member 21 (the first elastic contact pieces 22 and the second elastic contact pieces 23) mounted on the top surface 12*a* of the electrical connector 11 elastically deforms in an arrow-Z direction in FIG. 1, and gets into press contact with the male terminal due to the restoring force.

On the other hand, once the male terminal (unillustrated) is inserted into the electrical connector 11, the elastic contact member 21 (the first elastic contact pieces 22 and the second elastic contact pieces 23) mounted on the bottom surface 12*b* of the electrical connector 11 elastically deforms in an arrow-Z' direction in FIG. 1, and gets into press contact with the male terminal due to the restoring force.

As shown in FIGS. 1 and 2, a bottom wall 32 and squeeze pieces 33 are formed in the electrical wire crimp part 31. The core wire of the electrical wire (unillustrated) is positioned to the bottom wall 32. The squeeze pieces 33 are provided by being bent upward from the bottom wall 32. The squeeze pieces 33 are squeezed around the electrically-conductive body and cover of the electrical wire.

The electrical wire (unillustrated) is fixed to the bottom wall 32 by bending and squeezing the squeeze pieces 33 so as to wrap the electrical wire positioned to the bottom wall 32.

Once the male terminal (unillustrated) is inserted into the electrical connector 11, the female terminal 1 formed in the above-described way holds the male terminal between the elastic contact members 21 which are mounted on the respective two opposed surfaces (the top surface 12*a* and the bottom surface 12*b*).

Because, as described above, the male terminal is held between and by the elastic contact members 21 mounted on the respective two surfaces (the top surface 12*a* and the bottom surface 12*b*), the female terminal 1 (see FIG. 1) can enhance the reliability of the electrical connection between the female terminal 1 and the male terminal (unillustrated).

Next, detailed descriptions will be provided for a configuration of the elastic contact members 21 of the embodiment of the present invention by referring to FIGS. 3 and 4. FIG. 3 is a perspective view showing one elastic contact member 21 of the female terminal 1 of the first embodiment. FIG. 4 is a perspective view showing the elastic contact members 21 and the electrical wire crimp part 31 of the female terminal 1 of the first embodiment.

As described above, the two first elastic contact pieces 22 and the three second elastic contact pieces 23 are formed in each of the elastic contact members 21 which are mounted, respectively, on the top surface 12*a* and the bottom surface 12*b* of the electrical connector 11 (see FIG. 2).

As shown in FIG. 3, the multiple first elastic contact pieces 22 are formed with a space S in between in a widthwise direction (an arrow-Y direction in FIG. 3) orthogonal to the insertion direction of the male terminal (unillustrated) to be inserted into the electrical connector 11 (a arrow-X direction in FIG. 3).

Each first elastic contact piece 22 includes: a surface 21*c*; a cantilevered portion 22*a* which is cantilevered at a first end 21*a* side of the surface 21*c* in the insertion direction of the male terminal (unillustrated) (in an arrow-X direction in FIG. 3); a contact portion 22*b* designed to get into contact with the male terminal; and an free end 22*c* which is not fixed to the electrical connector 11.

The free end 22*c* side of the contact portion 22*b* of each first elastic contact piece 22 projects inward from a surface 21*c* (see FIG. 3) in a way that makes the contact portion 22*b* flush with a contact portion 23*b* of each second elastic contact piece 23, which will be described later.

As shown in FIG. 3, the multiple second elastic contact pieces 23 are formed with a space T between them in the widthwise direction (the arrow-Y direction in FIG. 3) orthogonal to the insertion direction of the male terminal (unillustrated) (the arrow-X direction in FIG. 3).

Each second elastic contact piece 23 includes: a cantilevered portion 23*a* which is cantilevered at a second end 21*b* side of the surface 21*c* in the insertion direction of the male terminal (unillustrated) (in the arrow-X direction in FIG. 3); a contact portion 23*b* designed to get into contact with the male terminal; and a free end 23*c* which is not fixed to the electrical connector 11.

As shown in FIG. 3, the first elastic contact pieces 22 and the second elastic contact pieces 23, which are formed in the above-described way, are formed integrally with the same surface.

The first elastic contact pieces 22 and the second elastic contact pieces 23 are formed at positions where the first elastic contact pieces 22 are shifted from the second elastic contact pieces 23 in the widthwise direction (the arrow-Y direction in FIG. 3).

For this reason, one of the second elastic contact pieces 23 can be easily disposed in the interstice (the space S) between the first elastic contact pieces 22, when the first elastic contact pieces 22 and the second elastic contact pieces 23 are subjected to the bending process.

When the elastic contact member 21 is folded back along the second end 21*b*, one of the second elastic contact pieces 23 can be easily disposed in the space S between the first elastic contact pieces 22, and the first elastic contact pieces 22 can be easily disposed in the spaces T between the second elastic contact pieces 23. In addition, the remaining two of the second elastic contact pieces 23 can be disposed at both sides of the first elastic contact pieces 22, respectively, with the space T from the one second elastic contact piece 23 disposed in the space S.

Because, as described above, the first elastic contact pieces 22 are disposed in the respective spaces T while one of the second elastic contact pieces 23 is disposed in the space S, the first elastic contact pieces 22 and the second elastic contact pieces 23 do not interfere with each other. This makes it possible to form each first elastic contact piece 22 and each second elastic contact piece 23 with a length which is almost equal to the full length of the male terminal (unillustrated) in the insertion direction (in the arrow-X direction in FIG. 3).

Accordingly, it is possible to increase the elastic force of each of the first and second elastic contact pieces 22, 23, and to reduce the insertion force with which the male terminal is inserted into the electrical connector 11.

Given the strength of the die for the elastic contact members 21, it is desirable that the space S between the first elastic contact pieces 22 and the space T between the second elastic contact pieces 23 should be long enough for the width of the die to have a certain dimension. However, if the space S between the first elastic contact pieces 22 and the space T between the second elastic contact pieces 23 are too wide, the number of elastic contact pieces formable per unit length in each elastic contact member 21 decreases in exchange for the increase in the rigidity of the die.

However, in the female terminal 1 (see FIG. 1) of the embodiment of the present invention, as shown in FIG. 3, one of the second elastic contact pieces 23 is disposed in the space S between the first elastic contact pieces 22, while the first elastic contact pieces 22 are disposed in the respective spaces T between the second elastic contact pieces 23. Thereby, the first elastic contact pieces 22 and the second elastic contact pieces 23 are staggered.

For this reason, though the space S between the first elastic contact pieces 22 and the space T between the second elastic contact pieces 23 need to be widen to form the first and second elastic contact pieces 22, 23 from the thick elastic contact member 21 by punching with the die, the number of first and second elastic contact pieces 22, 23 arranged per unit length in the elastic contact member 21 can be increased by effectively using the space S and the spaces T.

Because, as shown in FIG. 3, the first elastic contact pieces 22 and the second elastic contact pieces 23 mesh with each other, the length of each of the first and second elastic contact pieces 22, 23 can be made long enough. Accordingly, the elastic force of each of the first and second elastic contact pieces 22, 23 increases, and it is possible to reduce the insertion force with which the male terminal (unillustrated) is inserted into the electrical connector 11.

As shown in FIG. 4, each elastic contact member 21, which is designed as described above, is formed as the member separate from the electrical connector 11. This makes it possible to increase the yields of female terminals 1 (see FIG. 1) manufactured.

As shown in FIG. 4, the elastic contact members 21 are formed integrally with the electrical wire crimp part 31. This makes it possible to enlarge the electrically-connected portion between the elastic contact members 21 and the electrical wire crimp part 31, and thus to reduce the value of the resistance between the elastic contact members 21 and the electrical wire crimp part 31, as well as accordingly to curb heat generation attributable to an otherwise increase in the value of the resistance.

When the elastic contact members 21, which are designed as described above, are inserted into the electrical connector 11, the elastic contact members 21 are mounted, respectively, on the top surface 12*a* and the bottom surface 12*b* of the electrical connector 11 (see FIG. 1). Thus, the elastic contact members 21 get into contact with the male terminal (unillustrated) which is inserted into the electrical connector 11.

Figure 5:
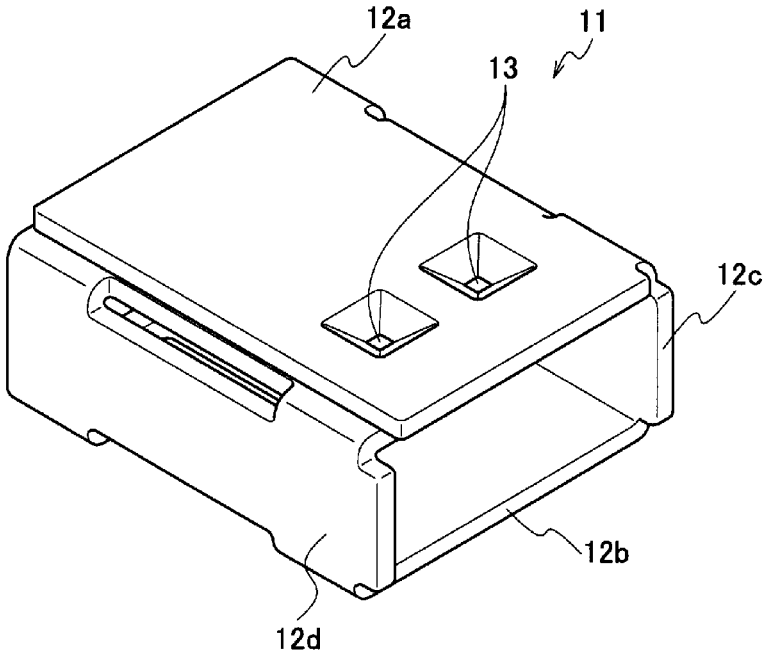
FIG. 5 is a perspective view showing an electrical connector of the female terminal according to the first embodiment of the present invention.
Figure 6:
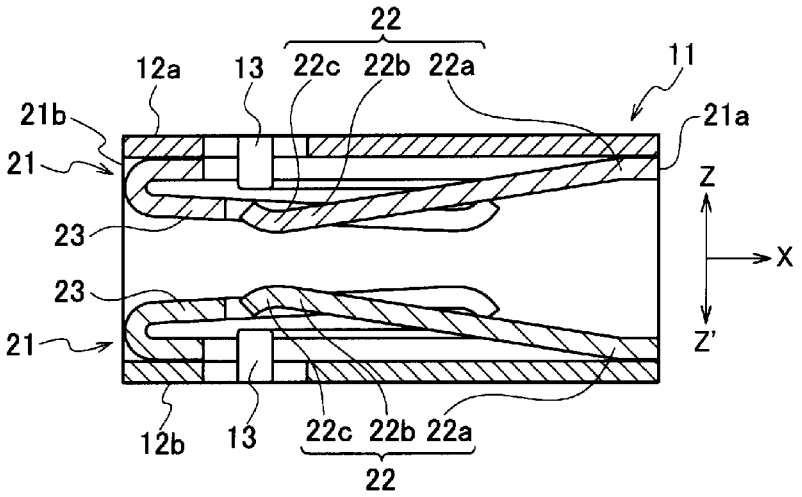
FIG. 6 is a cross-sectional view showing the electrical connector of the female terminal according to the first embodiment of the present invention.

Next, detailed descriptions will be provided for the excessive displacement preventing protrusions 13 of the first embodiment of the present invention by referring to FIG. 5 and FIG. 6. FIG. 5 is a perspective view showing the electrical connector 11 of the female terminal 1 of the first embodiment of the present invention. FIG. 6 is a cross-sectional view showing the electrical connector 11 of the female terminal 1 of the first embodiment of the present invention.

In the electrical connector 11, as described above, the excessive displacement preventing protrusions 13 configured to prevent excessive displacement of the corresponding elastic contact member 21 is provided to each of the surfaces (the top surface 12*a* and the bottom surface 12*b*) extending in the insertion direction of the male terminal (unillustrated) to be inserted into the inside of the electrical connector 11 (see FIG. 5 and FIG. 6).

The excessive displacement preventing protrusions 13 are each disposed with a predetermined clearance from the corresponding elastic contact member 21 in displacement direction of the elastic contact member 21 (in an arrow-Z direction or an arrow-Z' direction in FIG. 1) (see FIG. 6 for which descriptions will be provided later). The excessive displacement preventing protrusions 13 restrict the displacement of the elastic contact members 21 due to their contact with the male terminal (unillustrated) inserted in the electrical connector 11, so that the displacement is limited within the predetermined clearance.

As shown in FIG. 5 and FIG. 6, the excessive displacement preventing protrusions 13 are provided to the electrical connector 11 at places corresponding to the locations of the elastic contact members 21, with the number of excessive displacement preventing protrusions 13 corresponding to the number of elastic contact members 21 (or four which corresponds to the number of first elastic contact pieces 22, which is four, in the first embodiment of the present invention).

To put it specifically, as shown in FIG. 6, the excessive displacement preventing protrusions 13 are provided in the places which correspond to the locations of the first elastic contact pieces 22 when the elastic contact members 21 are installed in the electrical connector 11.

In other words, as described above, the free ends 22*c* of the first elastic contact pieces 22 project towards the inner side of the electrical connector 11 in the way that makes the contact portions 22*b* of the first elastic contact pieces 22 disposed flush with the contact portions 23*b* of the second elastic contact pieces 23. Accordingly, when the male terminal (unillustrated) is inserted into the electrical connector 11, each first elastic contact piece 22 provides greater elastic displacement.

For this reason, the excessive displacement preventing protrusions 13 are provided in the displacement directions in which the first elastic contact pieces 22 provide the elastic displacement (in an arrow-Z direction and in an arrow-Z' direction in FIG. 6), because the amount of elastic displacement provided by the first elastic contact pieces 22 is large when the male terminal (unillustrated) is inserted into the electrical connector 11.

In each first elastic contact piece 22, the amount of elastic displacement provided by the free end 22*c* is larger than the amount of elastic displacement provided by each of the cantilevered portion 22*a* and the contact portion 22*b*, when the male terminal (unillustrated) is inserted into the electrical connector 11.

With this taken into consideration, the excessive displacement preventing protrusions 13 are provided in the places which correspond to the locations near the free ends 22*c* when the elastic contact members 21 are installed in the electrical connector 11.

Because the excessive displacement preventing protrusions 13 are provided to the top surface 12*a* and the bottom surface 12*b* of the electrical connector 11, and in the places corresponding to the free ends 22*c* of the first elastic contact pieces 22, the excessive displacement preventing protrusions 13 are capable of preventing the excessive displacement of the first elastic contact pieces 22.

Because as shown in FIG. 5, the excessive displacement preventing protrusions 13 are provided to the electrical connector 11, it is possible to structurally achieve the excessive displacement preventing function for the elastic contact members 21 easily even though each elastic contact member 21 is constructed as the member separate from the electrical connector 11.

Because the electrical connector 11 and each elastic contact member 21 are thus formed as the members separate from each other, it is possible to easily form the excessive displacement preventing protrusions 13 depending on changes to be made to the places of the first and second elastic contact pieces 22, 23 and the number of first and second elastic contact pieces 22, 23.

Because the electrical connector 11 and each elastic contact member 21 are formed as the members separate from each other, the electrical connector 11, and the elastic contact members 21 together with the electrical wire crimp part 31 can be produced by using two small dies. This makes it possible to produce the female terminal 1 by use of a small pressing machine.

Figure 7:
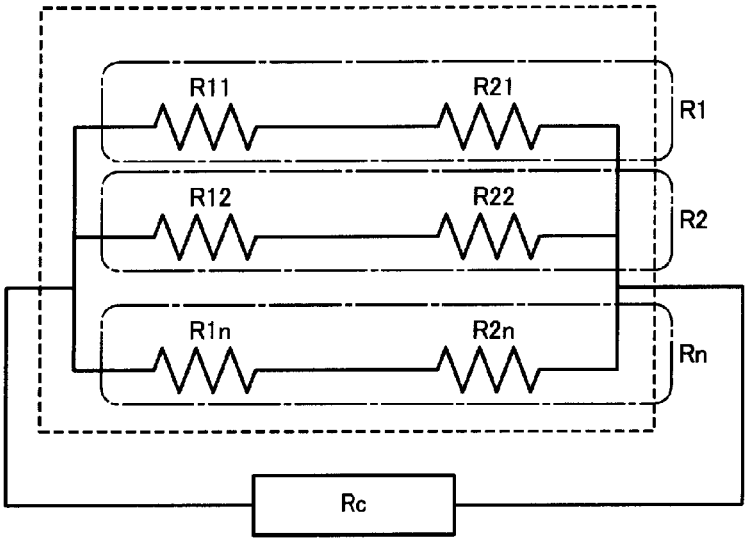
FIG. 7 is a diagram for explaining a resistance value of the female terminal according to the first embodiment of the present invention.

Next, descriptions will be provided for a resistance value of the female terminal 1 of the first embodiment by referring to FIG. 7. FIG. 7 is a diagram for explaining the resistance value of the female terminal 1 of the embodiment of the present invention.

As shown in FIG. 7, the resistance of any one of the first and second elastic contact pieces 22, 23 (see FIG. 3) takes a value which is obtained by the following expression $$R1=R11+R21$$

where R1 denotes a value of the resistance of the one of the first and second elastic contact pieces 22, 23; R11 denotes a value of the conductor resistance of the one of the first and second elastic contact pieces 22, 23 (which is expressed with the value of its material resistance multiplied by its length, and divided by its cross-sectional area); and R21 denotes a value of the contact resistance between the male terminal (unillustrated) and the one of the first and second elastic contact pieces 22, 23.

Accordingly, as shown in FIG. 7, the value Rc of the resistance of each elastic contact member 21 (see FIG. 3), which includes multiple first elastic contact pieces 22 and multiple second elastic contact pieces 23, can be obtained by the following equation $$1/R1+1/R2+\ldots+1/Rn=1/Rc,$$

like a value of a resistance of a parallel circuit.

For this reason, when multiple elastic contact pieces 22 and multiple elastic contact pieces 23 are provided to each elastic contact member 21 (see FIG. 3), it is possible to reduce a value of the contact resistance between the male terminal (unillustrated) and the elastic contact member 21.

To put it specifically, in a case where the value of the contact resistance between the male terminal (unillustrated) and each elastic contact member 21 as a whole (see FIG. 3) is assumed to be 1 (one) when one elastic contact piece is provided to the elastic contact member 21, the value of the contact resistance in between is reduced to 0.1 when 10 of the first and second elastic contact pieces 22, 23 are provided to the elastic contact member 21.

Accordingly, when the number of contact points between the elastic contact member 21 (see FIG. 3) and the male terminal (unillustrated) is increased by providing multiple first elastic contact pieces 22 and multiple second elastic contact pieces 23 to the elastic contact member 21 (see FIG. 3), it is possible to reduce the resistance of the elastic contact member 21.

When, as described above, multiple first elastic contact pieces 22 and multiple second elastic contact pieces 23 are provided to the elastic contact member 21 (see FIG. 3), this increases the cross-sectional area of current flow in the elastic contact member 21, as well as the number of contact points between the elastic contact member 21 and the male terminal (unillustrated). This increases the number of parallel circuits in accordance with the increase in the number of first elastic contact pieces 22 and the number of second elastic contact pieces 23. For this reason, it is possible to reduce the value of the resistance of the elastic contact member 21.

The first elastic contact pieces 22 (see FIG. 3) and the second elastic contact pieces 23 (see FIG. 3) can be increased in number while securing the cross-sectional area of current flow in the elastic contact member 21. This makes it possible to reduce the value of the resistance of the elastic contact member 21, and accordingly to produce the female terminal 1 (see FIG. 1) in a smaller size.

Figure 8:
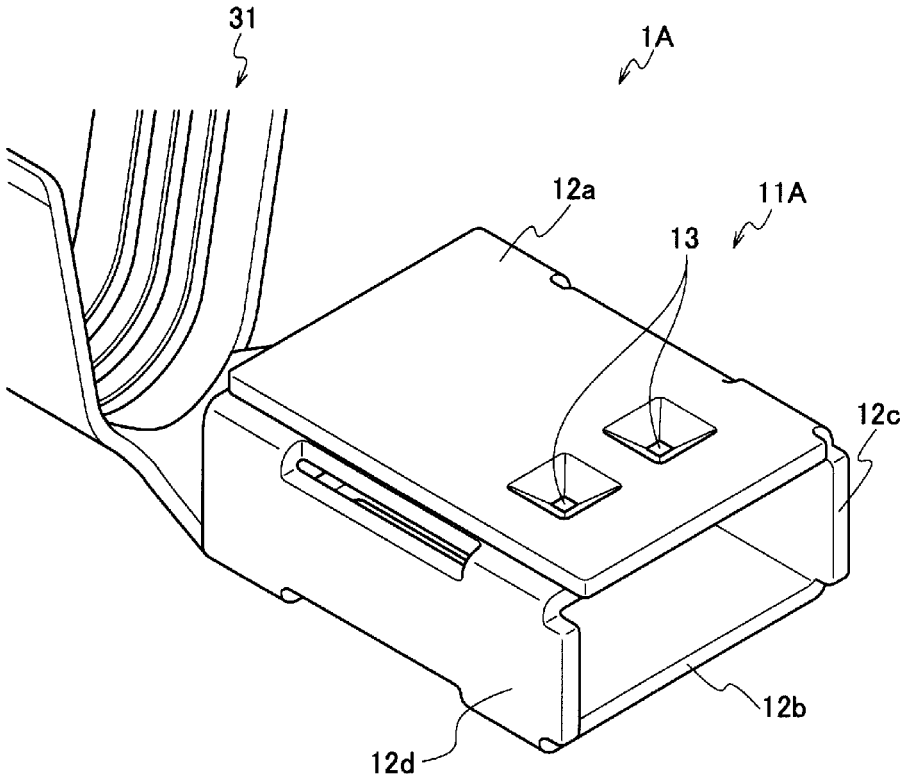
FIG. 8 is a perspective view showing an electrical connector and an electrical wire crimp part of a female terminal according to a second embodiment of the present invention.
Figure 9:
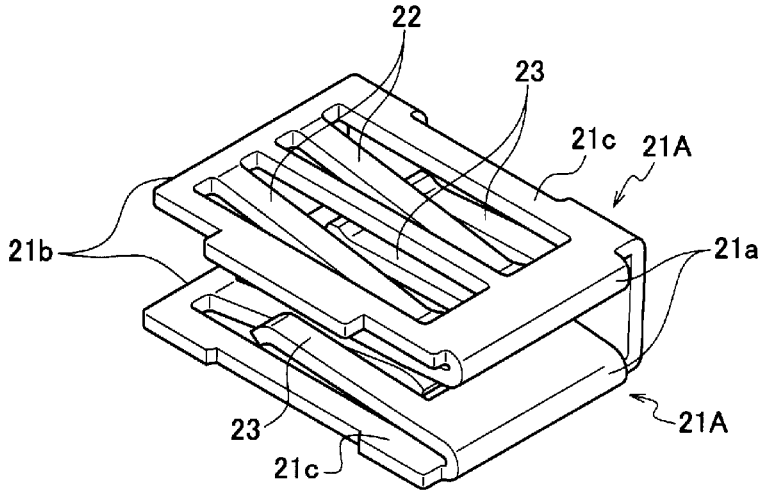
FIG. 9 is a perspective view showing elastic contact members of the female terminal according to the second embodiment of the present invention.

Next, detailed descriptions will be provided for a female terminal 1A according to a second embodiment of the present invention by referring to FIG. 8 and FIG. 9. FIG. 8 is a perspective view showing an electrical connector 11A and an electrical wire crimp part 31 of the female terminal 1A of the second embodiment of the present invention. FIG. 9 is a perspective view showing elastic contact members 21A of the female terminal 1A of the second embodiment of the present invention.

It should be noted that the female terminal 1A of the second embodiment has almost the same configuration and the like as does the female terminal 1 of the first embodiment. For this reason, descriptions for the same configuration will be omitted. In addition, the descriptions will be provided while denoting components, which are the same as those of the female terminal 1 of the first embodiment, with the same reference signs.

The foregoing descriptions have been provided for the female terminal 1 (see FIG. 1) of the first embodiment in which, as described above, the elastic contact members 21 and the electrical wire crimp part 31 are formed integrally with each other (see FIG. 4). In contrast, in the female terminal 1A of the second embodiment of the present invention, as shown in FIG. 8, the electrical connector 11A is formed integrally with the electrical wire crimp part 31.

This makes it possible to enlarge the electrically-connected portion between the electrical connector 11A and the electrical wire crimp part 31, and thus to reduce the value of the resistance between the electrical connector 11A and the electrical wire crimp part 31, as well as accordingly to curb heat generation attributable to an otherwise increase in the value of the resistance.

When the elastic contact members 21A shown in FIG. 9 are inserted into the electrical connector 11A which is formed integrally with the electrical wire crimp part 31, the elastic contact members 21A are respectively mounted on the top surface 12*a* and the bottom surface 12*b* of the electrical connector 11A (see FIG. 8), and the elastic contact members 21A get into contact with the male terminal (unillustrated) which is inserted into the electrical connector 11A.

Even in the case where, as described above, the electrical connector 11 A and the electrical wire crimp part 31 are formed integrally with each other, it is possible to reduce the resistance caused by the contact between the female terminal 1A and the male terminal (unillustrated), and accordingly to bring about the same working-effect as does the female terminal 1 of the first embodiment.

As described above, the female terminal 1, 1A of the embodiments of the present invention includes: the electrical connector 11, 11A into which the male terminal is to be inserted; and the elastic contact members 21, 21A capable of getting into contact with the male terminal inserted in the electrical connector 11, 11A. The electrical connector 11, 11A and the elastic contact members 21, 21A are formed as members separate from each other. Each elastic contact member 21, 21A includes: the multiple first elastic contact pieces 22 formed with the space S in between in the widthwise direction (the arrow-Y direction) orthogonal to the insertion direction of the male terminal to be inserted into the electrical connector 11, 11A (the arrow-X direction), each first elastic contact piece 22 being cantilevered at the first end 21*a* side, in the insertion direction (in the arrow-X direction), of the surface of the elastic contact member 21, 21A extending in the insertion direction of the male terminal to be inserted into the electrical connector 11, 11A (in the arrow-X direction); and the second elastic contact pieces 23, one of which is disposed in the space S. The first elastic contact pieces 22 and the second elastic contact pieces 23 get into contact with the male terminal inserted in the electrical connector 11, 11A.

In the female terminal 1, 1A of the embodiments of the present invention, the electrical connector 11, 11A has the excessive displacement preventing protrusions 13, which are configured to prevent excessive displacement of either or both of the first elastic contact pieces 22 and the second elastic contact pieces 23 of the elastic contact member 21, 21A, in at least one (the top surface 12*a*, the bottom surface 12*b*) of the surfaces extending in the insertion direction of the male terminal to be inserted into the electrical connector 11, 11A (in the arrow-X direction). Once the elastic contact members 21, 21A are installed in the electrical connector 11, 11A, the excessive displacement preventing protrusions 13 are disposed with the predetermined clearance, in the displacement direction, from either or both of the first elastic contact pieces 22 and the second elastic contact pieces 23 (in the arrow-Z direction and/or in the arrow-Z' direction). The excessive displacement preventing protrusions 13 restrict the displacement of either or both of the first elastic contact pieces 22 and the second elastic contact pieces 23 due to their contact with the male terminal to be inserted into the electrical connector 11, 11A, so that the displacement is limited within the predetermined clearance.

In the female terminal 1, 1A of the embodiments of the present invention, the first elastic contact pieces 22 and the second elastic contact pieces 23 are formed integrally with the surface 21*c*. One of the second elastic contact pieces is disposed in the space S by folding back the second elastic contact pieces at the second end 21*b* of the surface 21*c* in the insertion direction (in the arrow-X direction).

In the female terminal 1 of the embodiments of the present invention, the elastic contact member 21, 21A is mounted on each of the two opposed surfaces (the top surface 12*a*, the bottom surface 12*b*) of the electrical connector 11, 11A. The male terminal is held between and by the elastic contact members 21, 21A mounted on the respective two surfaces (the top surface 12*a*, the bottom surface 12*b*).

The female terminal 1, 1A of the embodiments of the present invention makes it possible to increase the number of first and second elastic contact pieces 22, 23 formable in each elastic contact member 21, 21A even if the space S between the first elastic contact pieces 22 and the space T between the second elastic contact pieces 23 are expanded, because the second elastic contact piece 23 is disposed in the space S between the first elastic contact pieces 22. For this reason, owing to the process easiness in processing the elastic contact member 21, 21A formed as a separate member, more first and second elastic contact pieces 22, 23 than ever can be formed in the elastic contact member 21, 21A without sacrificing the life of the die used to punch portions from the elastic contact member 21, 21A to form the space S between the first elastic contact pieces 22 and the space T between the second elastic contact pieces 23.

The female terminal 1, 1A of the embodiments of the present invention makes it possible to prevent excessive displacement of each elastic contact member 21, 21A, because the electrical connector 11, 11A formed as the member separate from the elastic contact member 21, 21A includes the excessive displacement preventing protrusions 13.

Because the excessive displacement preventing protrusions 13 are provided to the electrical connector 11, 11A, it is possible to structurally achieve the excessive displacement preventing function for each elastic contact member 21, 21A easily even though the elastic contact member 21, 21A is constructed as the member separate from the electrical connector 11, 11A.

In the female terminal 1, 1A of the embodiments of the present invention, one of the second elastic contact pieces 23 is disposed in the space S between the first elastic contact pieces 22. For this reason, it is possible to make each first elastic contact piece 22 and each second elastic contact piece 23 long in the insertion direction of the male terminal. Accordingly, it is possible to enhance the elastic force of each first elastic contact piece 22 and the elastic force of each second elastic contact piece 23, and thereby to reduce the insertion force with which the male terminal is inserted into the electrical connector 11, 11A.

In the female terminal 1, 1A of the embodiments of the present invention, the first elastic contact pieces 22 and the second elastic contact pieces 23 are formed integrally with the same surface 21*c*. For this reason, when the first elastic contact pieces 22 and the second elastic contact pieces 23 are formed in the way that stagger the first elastic contact pieces 22 and the second elastic contact pieces 23 in the spacing direction of the first elastic contact pieces 22 (in the arrow-Y direction), the one of the second elastic contact pieces 23 can be easily disposed between the first elastic contact pieces 22 during the process in which the first elastic contact pieces 22 and the second elastic contact pieces 23 are bent.

In the female terminal 1, 1A of the embodiments of the present invention, the male terminal is held between and by the elastic contact members 21, 21A mounted on the respective two surfaces (the top surface 12*a*, the bottom surface 12*b*) of the electrical connector 11, 11A. For this reason, it is possible to enhance the reliability of the electrical connection between the female terminal and the male terminal.

Although the present invention has been described above by reference to the embodiments, the present invention is not limited to those and the configuration of parts can be replaced with any configuration having a similar function.

Although the foregoing descriptions have been provided for the female terminal 1, 1A of the embodiments of the present invention in which the electrical contact member 21, 21A is mounted on each of the top surface 12*a* and the bottom surface 12*b* of the electrical connector 11, 11A, the electrical contact member 21, 21A may be mounted, for example, on at least one of the top surface 12*a* and the bottom surface 12*b*.

Although the foregoing descriptions have been provided for the female terminal 1, 1A of the first embodiment of the present invention in which the two first elastic contact pieces 22 and the three second elastic contact pieces 23 are formed in each elastic contact member 21, 21A, the number of first elastic contact pieces 22 and the number of second elastic contact pieces 23 may be changed depending on the necessity.

Although the foregoing descriptions have been provided for the female terminal 1, 1A of the first embodiment of the present invention in which the excessive displacement preventing protrusions 13 are provided to each of the top surface 12*a* and the bottom surface 12*b* of the electrical connector 11, 11A, any changes may be made to the placement of the excessive displacement preventing protrusions 13 depending on how many elastic contact members 21, 21A are provided to the female terminal 1, 1A.

Although the foregoing descriptions have been provided for the female terminal 1, 1A of the first embodiment of the present invention in which each elastic contact member 21, 21A includes the first elastic contact pieces 22 and the second elastic contact pieces 23, the female terminal 1, 1A is not limited to this case.

In other words, it is sufficient that each elastic contact member 21, 21A of the female terminal 1, 1A of the present invention include multiple elastic contact pieces which are formed with a space between them in the widthwise direction orthogonal to the insertion direction of the male terminal to be inserted into the electrical connector 11, 11A, each elastic contact piece being cantilevered at one end of the elastic contact member 21, 21A in the insertion direction of the male terminal.

Although in the female terminal 1, 1A of the embodiments of the present invention, the excessive displacement preventing protrusions 13 are formed to each of the top surface 12*a* and the bottom surface 12*b* of the electrical connector 11, 11A, the excessive displacement preventing protrusion 13 instead may be omitted from either the top surface 12*a* or the bottom surface 12*b*, or from both of the top surface 12*a* and the bottom surface 12*b*. The excessive displacement preventing protrusions 13 may be configured to prevent excessive displacement of at least either the first elastic contact pieces 22 or the second elastic contact pieces 23.

The entire content of Japanese Patent Application No. 2011-137170, filed on Jun. 21, 2011, is herein incorporated by reference.

The invention claimed is:

1. A female terminal comprising:

an electrical connector for a male terminal to be inserted; and an elastic contact member formed as a member separate from the electrical connector, installed in the electrical connector, and configured to get into contact with the male terminal inserted in the electrical connector, wherein the elastic contact member comprises a base in contact with an inner surface of the electrical connector first elastic contact pieces formed with a space in between in a widthwise direction orthogonal to an insertion direction of the male terminal to be inserted into the electrical connector, the first elastic contact pieces being cantilevered to the base, in the insertion direction, a surface of the elastic contact member extending from the base in the insertion direction, and configured to contact the male terminal inserted into the electrical connector, and a second elastic contact piece disposed in the space, configured to contact the male terminal inserted into the electrical connector, the second elastic contact piece being cantilevered to and extending from the base in an opposite direction of the insertion direction.

2. The female terminal according to claim 1, wherein the electrical connector comprises an excessive displacement preventing protrusion in at least one of surfaces of the electrical connector extending in the insertion direction, the excessive displacement preventing protrusion being configured to prevent excessive displacement of at least one of the first and second elastic contact pieces, the excessive displacement preventing protrusion is disposed with a predetermined clearance in a displacement direction of and from the at least one of the first and second elastic contact pieces of the elastic contact member installed in the electrical connector, and the excessive displacement preventing protrusion restricts displacement of the at least one of the first and second elastic contact pieces due to a contact with the male terminal inserted in the electrical connector to limit the displacement within the predetermined clearance.

3. The female terminal according to claim 1, wherein the first elastic contact pieces and the second elastic contact piece are formed integrally with the surface of the elastic contact member, and the second elastic contact piece is disposed in the space by being folded back at an other end side of the surface of the elastic contact member in the insertion direction.

4. The female terminal according to claim 1, comprising elastic contact members respectively mounted on two opposite surfaces of the electrical connector, wherein the elastic contact members mounted on the two surfaces of the electrical connector hold the male terminal therebetween.

5. The female terminal according to claim 1, wherein respective ends of the first elastic contact pieces are fixed to a first side of the base, and an end of the second elastic contact piece is fixed to a second side of the base opposite the first side.

6. The female terminal according to claim 1, wherein the elastic contact member is integral to the female terminal, and the electrical connector is detachably coupled to the female terminal.

7. The female terminal according to claim 4, wherein the electrical connector further comprises a first excessive displacement preventing protrusion on a first of the two opposite surfaces of the electrical connector and a second excessive displacement preventing protrusion on a second of the two opposite surfaces of the electrical connector, the first excessive displacement preventing protrusion is disposed with a predetermined clearance in a displacement direction from at least one of the first elastic contact pieces of the elastic contact member installed in the electrical connector, the first excessive displacement preventing protrusion restricts displacement of the at least one of the first elastic contact pieces, the second excessive displacement preventing protrusion is disposed with a predetermined clearance in a displacement direction from the second elastic contact pieces of the elastic contact member installed in the electrical connector, and the second excessive displacement preventing protrusion restricts displacement the second elastic contact piece.

8. The female terminal according to claim 4, wherein a second base is in contact with a second inner surface of the electrical connector opposite the inner surface, elastic contact members mounted on the inner surface of the electrical connector comprise at least a first cantilevered arm fixed to a first side of the base and extending therefrom in the insertion direction and a second cantilevered arm fixed to a second side of the base and extending therefrom in the opposite direction, and elastic contact members mounted on the second inner surface of the electrical connector comprise at least a first cantilevered arm fixed to a first side of the second base and extending therefrom in the insertion direction and a second cantilevered arm fixed to a second side of the second base and extending therefrom in the opposite direction.

9. The female terminal according to claim 4, wherein a second base is mounted on a second inner surface of the electrical connector opposite the inner surface, elastic contact members mounted on the inner surface of the electrical connector comprise first arms cantilevered to the base, elastic contact members mounted on the second inner surface of the electrical connector comprise second arms cantilevered the second base, all of first arms extend from the base in the insertion direction, and all of the second arms extend from the second base in the opposite direction.

* * * * *